US006259238B1

(12) United States Patent
Hastings

(10) Patent No.: US 6,259,238 B1
(45) Date of Patent: Jul. 10, 2001

(54) BROKAW TRANSCONDUCTANCE OPERATIONAL TRANSCONDUCTANCE AMPLIFIER-BASED MICROPOWER LOW DROP OUT VOLTAGE REGULATOR HAVING COUNTERPHASE COMPENSATION

(75) Inventor: Roy Alan Hastings, Allen, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 09/470,910

(22) Filed: Dec. 23, 1999

(51) Int. Cl.[7] ..... G05F 1/40
(52) U.S. Cl. ..... 323/280; 323/273
(58) Field of Search ..... 323/273, 280, 323/313, 314

(56) References Cited

U.S. PATENT DOCUMENTS 4,710,728 * 12/1987 Davis ..... 330/252
4,792,745 * 12/1988 Dobkin ..... 323/269
4,851,953 * 7/1989 O'Neill et al. ..... 361/101
4,902,959 * 2/1990 Brokaw ..... 323/314
5,672,962 * 9/1997 Sweeney ..... 323/315
5,686,821 * 11/1997 Brokaw ..... 323/273

* cited by examiner

*Primary Examiner*—Adolf Deneke Berhane
(74) *Attorney, Agent, or Firm*—April M. Mosby; W. James Brady; Frederick J. Telecky, Jr.

(57) ABSTRACT

A micropower low-dropout regulator (LDO) (30) having a low dropout voltage and a compensating impedance for compensating base current errors. The new compensation technique involves placing a shunt capacitor ($C_2$) at a counterphase input (node A) of a Brokaw transconductance cell incorporating a base current compensation resistor ($R_5$). The resistor ($R_5$) and capacitor ($C_2$) provide a zero frequency that does not depend upon the attenuation ratio of the feedback divider. The counterphase compensation capacitor ($C_2$)provides a low-frequency zero using a reasonably sized capacitor, and provides a pole-zero separation that does not depend upon the attenuator ratio, without additional current-consuming components.

15 Claims, 1 Drawing Sheet

BROKAW TRANSCONDUCTANCE OPERATIONAL TRANSCONDUCTANCE AMPLIFIER-BASED MICROPOWER LOW DROP OUT VOLTAGE REGULATOR HAVING COUNTERPHASE COMPENSATION

FIELD OF THE INVENTION

The present invention is generally related to voltage regulator circuits, and more particularly low quiescent current regulators.

BACKGROUND OF THE INVENTION

The "dropout voltage" of a voltage regulator equals the minimum input-to-output voltage differential for which the circuit can maintain output regulation. Low-dropout (LDO) voltage regulators generally have dropout voltages of a few tenths of a volt at full rated current. In order to achieve such low dropout voltages, the circuit must use a PNP or PMOS pass element. FIG. 1 shows a simplified block diagram of a typical prior art PMOS LDO circuit 10. The pass element is MOS transistor $M_1$, which is driven by amplifier $A_1$. The amplifier in turn receives the voltage generated by an internal voltage reference $VR_1$, and the voltage produced by a voltage divider network $R_1$–$R_2$. The circuit 10 is connected so that the amplifier achieves equilibrium when the voltage on the tap T of the voltage divider equals the voltage generated by the reference $VR_1$.

Many LDO applications require that the regulator consume little current to power its internal circuitry. This quiescent current typically equals 100 $\mu$A for a modern PMOS LDO, and this changes little regardless of output current. The conventional topology of FIG. 1 can be extended to provide low-current operation, typically down to 10 $\mu$A. Lower currents require nonconventional circuit topologies.

The micropower LDO architecture contains multiple poles at relatively low frequencies, and therefore requires the insertion of compensating zeros to boost the phase, or otherwise the phase margin will deteriorate to the point that the circuit becomes unstable. These zeros are difficult to generate using integrated components because they must lie at relatively low frequencies (10–100 kHz), they must not use large amounts of die area, and they must not consume any current. There are two basic techniques that have been used to insert zeros in this type of LDO architecture:

1) Placing a resistor Resr in series with the load capacitor $C_L$ producing a zero at $w=1/(R_{esr}\times C_L)$. This can't make a low-frequency pole for a small capacitor value unless a large resistor $R_{esr}$ is used, which is undesirable. Since micropower architectures have low bandwidth, they require low-frequency poles and this isn't a good solution—by itself.
2) Place a capacitor C (not shown) across the upper resistor $R_1$ of the feedback divider; this produces a zero at $w=1/(R_1\times C)$. This doesn't work well for small divider ratios because the pole-zero separation becomes too small.

SUMMARY OF THE INVENTION

The present invention achieves technical advantages as a micropower low-dropout voltage regulator having a shunt capacitor at the counterphase input of a Brokaw transconductance cell including a base current compensation resistor.

This resistor and capacitor provides a zero frequency that does not depend upon the attenuation ratio of the feedback divider. The counterphase compensation capacitor provides a low-frequency zero using a reasonably sized capacitor, providing a pole-zero separation that does not depend upon the attenuator ratio, and which requires no additional current-consuming components. The present invention can be combined with both feedback bypass compensation and ESR compensation to provide a wide-range phase boost capable of compensating a micropower LDO based upon the Brokaw transconductance cell. The configuration can be generally applied to any amplifier based on the Brokaw cell.

According to the preferred embodiment of the present invention, a voltage regulator produces an output signal and has a Brokaw cell comprising a first transistor and a second transistor. A compensation circuit is coupled to the Brokaw cell and generates a pole-zero pair in the Brokaw cell. Each of the first and second transistors have a base, wherein the compensation circuit comprises a base-current compensating resistor coupled between the first and second transistor bases. The compensation circuit also comprises a capacitor coupled to the compensating resistor.

The first and second transistors operate in counterphase to generate respective output signals 180° out-of-phase to one another. The compensation circuit is configured to provide a phase boost approaching 90° and which is independent of the output signal of the voltage regulator. The compensation circuit is configured to compensate the voltage regulator even when the regulator has a low feedback attenuation ratio.

The pole-zero pair defines a pole-zero separation, wherein the pole-zero separation is independent of attenuation ratio of the voltage regulator. The compensation circuit can be combined with a feedback bypass compensation circuit and an ESR compensation circuit to provide a wide-range phase boost. Preferably, the Brokaw cell is configured as an operational transconductance amplifier (OTA).

DETAILED DESCRIPTION OF THE PRIOR ART

Figure 2:
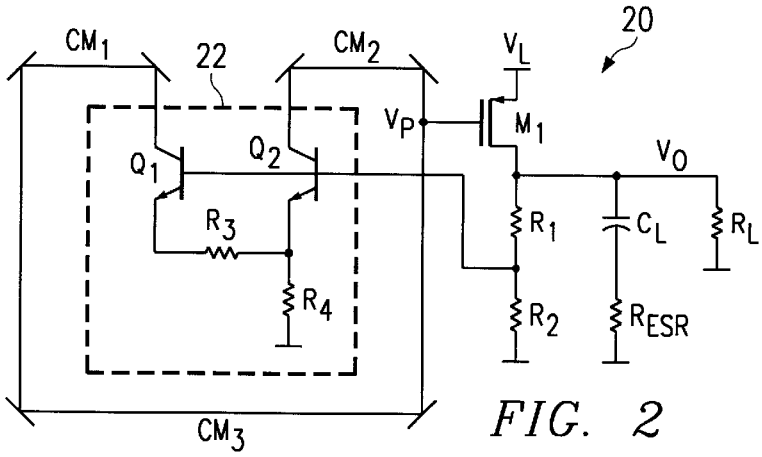
FIG. 2 is a schematic diagram of a Brokaw transconductance cell having a lower quiescent current by merging the amplifier and the voltage reference blocks into a single circuit with a minimum number of current limbs.

One approach to reducing quiescent current consists of merging the amplifier and voltage reference blocks into a single circuit with a minimum number of current limbs. A class of operational transconductance amplifier (OTA) circuits based on the Brokaw transconductance cell fulfill this goal. FIG. 2 shows the basic topology of such a circuit 20. The Brokaw transconductance cell consists of bipolar transistors $Q_1$ and $Q_2$ and resistors $R_3$ and $R_4$, shown at 22. The emitter area of transistor $Q_1$ is an integer multiple N of the emitter area of transistor $Q_2$. At equilibrium, where $I_{C1}=I_{C2}$, the voltage imposed across resistor $R_3$ equals:

$$V_{R3}=V_T 1n(N)$$

where $V_T$ is the thermal voltage. The currents through transistors $Q_1$ and $Q_2$ are both imposed across $R_4$, so the voltage seen at the input of the Brokaw cell, $V_{bg}$, equals:

$$V_{bg} = V_{be2} + 2V_T \frac{R4}{R3} \ln(N)$$

This is the classic bandgap equation derived by Brokaw. If the input voltage to the cell is less than the equilibrium value $V_{bg}$, then $I_{C1}>I_{C2}$; if the input voltage is greater than $V_{bg}$, then $I_{C1}<I_{C2}$. The OTA architecture feeds the currents $I_{C1}$ and $I_{C2}$ into mirrors $CM_1$ and $CM_2$, and then uses another mirror $CM_3$ to invert the output of $CM_1$. Since $CM_3$ operates against $CM_2$, the current into or out of node $V_p$ equals $I_{C2}-I_{C1}$, and this current equals zero only when the circuit rests at equilibrium. Any disturbance from equilibrium causes a current $I_{C2}-I_{C1}$ that seeks to restore equilibrium.

Figure 1:
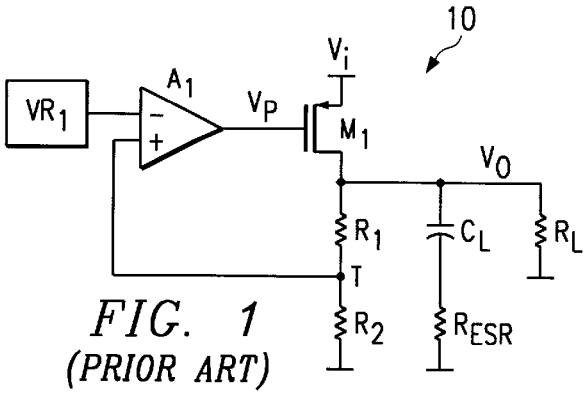
FIG. 1 (PRIOR ART)
FIG. 1 is a schematic diagram of a prior art low-dropout (LDO) voltage regulator based on a Brokaw transconductance cell.

The OTA described above acts both as its own reference and as an amplifier, so it replaces components $VR_1$ and $A_1$ in FIG. 1. FIG. 2 shows how a complete LDO could be implemented around the OTA. This circuit has a very small number of current paths (five in all, four in the OTA and one in the resistor divider $R_3$ and $R_4$), making it a candidate for a micropower LDO.

Figure 3:
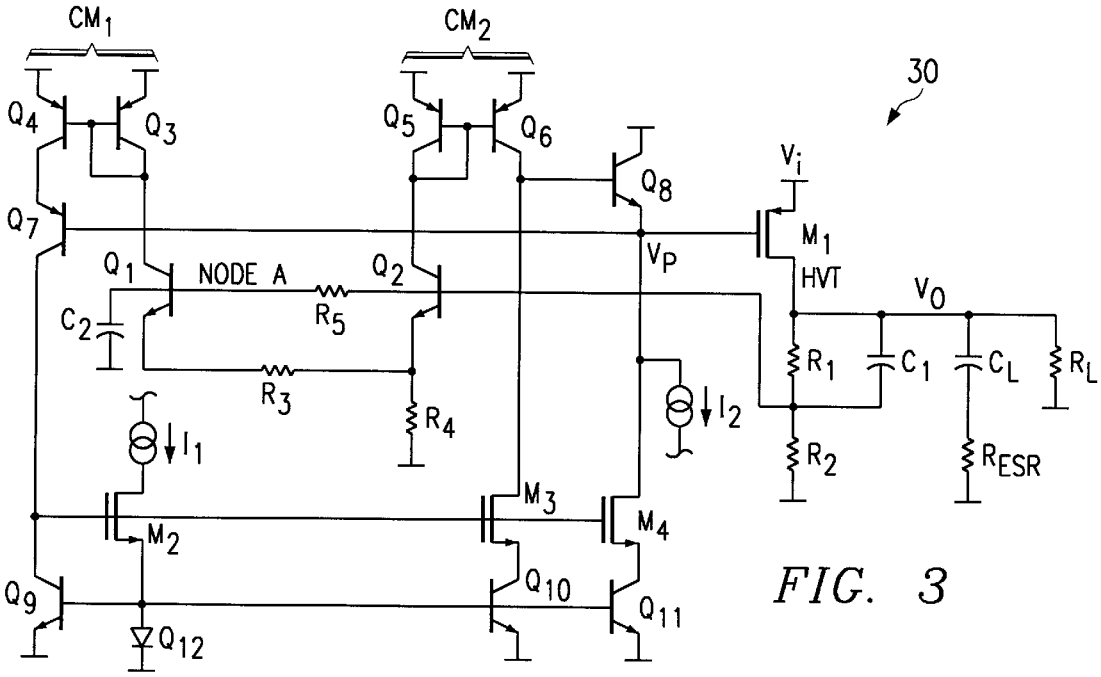
FIG. 3 is a schematic diagram of the present invention including a Brokaw transconductance cell having a base current compensation resistor and a capacitor producing a zero frequency, the capacitor effecting only the two transistors of the Brokaw cell.

Referring now to the present invention comprising circuit 30 in FIG. 3, circuit 30 shows a practical implementation of a micropower LDO. Current mirrors $CM_1$ and $CM_2$ have been implemented as PNP transistors $Q_3$–$Q_4$ and transistors $Q_5$–$Q_6$. Current mirror $CM_3$ has been implemented as NPN transistors $Q_9$–$Q_{10}$ with a MOS beta helper transistor $M_2$ biased by diode-connected transistor $Q_{12}$. In order to prevent excessive current flow when transistor $Q_{10}$ saturates, a current limiting component $I_1$ (typically a depletion-mode MOS transistor) has been inserted above the beta helper.

In order to minimize the impedance at node $V_p$, it is traditional to insert a follower stage, in this case consisting of emitter follower transistor $Q_8$ biased by a limb of the lower current mirror based on transistor $Q_{11}$. In order to obtain adequate headroom for transistor $Q_8$, transistor $M_1$ must have a high threshold voltage ($V_t$>1 V). This arrangement doesn't necessarily reduce the impedance at node $V_p$ as much as desired because the output impedance of transistor $Q_8$ depends inversely upon its emitter current, and low currents therefore prevent one from taking full advantage of transistor $Q_8$. However, this stage is still necessary in order to allow proper implementation of a startup circuit, as will be explained below.

Because the Brokaw transconductance cell transistors $Q_1$-$Q_2$-$R_3$-$R_4$ has a very low transconductance, the OTA must have a relatively high output impedance. This is achieved in part by adding a cascode transistor $M_3$ to the output limb of the lower current mirror $CM_3$. This transistor can be biased from beta helper transistor $M_1$ due to the addition of diode transistor $Q_{12}$, which ensures that the current through transistors $M_1$ and $M_2$ have a definite relationship to one another (as would not be the case if this diode were omitted). A cascode on transistor $Q_6$ could provide a higher output impedance, but only at the price of degrading the already-minimal headroom of transistor $Q_8$. FIG. 3 shows a better solution, consisting of a backside-cascode transistor $Q_7$ which holds the collector of transistor $Q_4$ at virtually the same voltage as the collector of transistor $Q_6$, thus eliminating most of the output voltage variations that low gain would otherwise produce.

As with most Brokaw-derived amplifiers, the OTA circuit 30 of FIG. 3 has a secondary equilibrium point at zero bias. In order to perturb the circuit and ensure startup, a small current source $I_2$ has been added which pulls down on the gate of transistor $M_1$ to begin start-up. In practice, $I_2$ could be a depletion-mode transistor. In order to prevent this current from disturbing the OTA, an isolation stage must be inserted between the output of the OTA and node $V_p$; in this circuit emitter follower transistor $Q_8$ performs this function. Transistor $M_4$ has been added to balance the limbs of mirror $CM_3$, but is not absolutely necessary.

Compensating the Micropower LDO

LDO voltage regulators are notoriously difficult to compensate. The typical LDO (FIG. 1) is dominated by two poles: a load pole formed by the load capacitance $C_L$, and a gate pole formed by the gate capacitance of transistor $M_1$ looking into the output impedance of amplifier $A_1$. In micropower LDO circuits, the extremely low currents used in the amplifier cause it to exhibit a very high output impedance. Consider the case of the amplifier of FIG. 3, which uses an emitter-follower output stage biased at a current $I_0$, giving an output impedance of:

$$R_o = \frac{V_T}{I_o}$$

which for a typical bias current $I_0$ of 0.5 $\mu$A gives an output impedance of 52 kΩ. The gate pole frequency $f_g$ depends upon the gate capacitance $C_g$ and equals:

$$fg = \frac{1}{2\pi R_o C_g}$$

assuming a typical gate capacitance of 100 pF, the gate pole falls at 31 kHz. The load pole falls at a frequency $f_L$:

$$f_L = \frac{1}{2\pi R_L C_L}$$

This pole can move through a wide range of frequencies, depending upon the load resistance $R_L$. Typically, the stability becomes poorest for the lowest $R_L$ (in other words, at the highest currents). Under these conditions, $f_L$ moves out to a higher frequency and approaches (or even exceeds) the frequency of the gate pole. For example, for $R_L$=3Ω, $C_L$=1 $\mu$F; $f_L$=53 kHz. Given that $f_g$ and $f_L$ appear at nearly the same frequency, this system is virtually guaranteed to become unstable and to oscillate in the 30–50 kHz band.

There are only two fundamental approaches to achieving stability: 1) push out the gate pole, and 2) insert zeros into the transfer function (lead compensation). Pushing out the gate pole to higher frequencies implies a reduction in the output impedance of amplifier $A_1$, which cannot be achieved without consuming larger currents or using smaller output transistors. This approach is therefore impractical in a micropower LDO, and some form of lead compensation must be used.

The two classical techniques of generating lead compensation in LDO's are the insertion of an ESR zero and the insertion of a feedback bypass capacitor. The ESR zero capacitor appears in FIG. 1 as $R_{esr}$. This resistor generates a zero by operating against load capacitor $C_L$, and the resulting ESR zero appears at a frequency $f_{esr}$:

$$f_{esr} = \frac{1}{2\pi R_{esr} C_L}$$

Classically, stability is achieved by pushing out the gate pole at least a decade from the load pole, and by then dropping the ESR zero onto the gate pole to achieve a pseudo-one-pole system. This cannot be done in micropower LDO's because the gate pole lies at too low a frequency, and the ESR zero cannot reach these low frequencies with practical values of ESR resistance. Most users object to more than 0.5Ω of ESR, and in combination with a 1 μF load capacitor, the ESR can only reach down to about 300 kHz, which is far above the 31 kHz of the gate pole in the sample system discussed above.

The feedback bypass capacitor has better possibilities in micropower circuits. This capacitor appears in the circuit 30 of FIG. 3 as capacitor $C_1$. Assuming the input impedance of the amplifier is "large", the transfer function $V_0/V_i$ across the feedback divider is:

$$H = \frac{R_2}{(R_1 + R_2)} \frac{1 + SC_1R_1}{1 + SC_1\frac{R_1R_2}{R_1 + R_2}}$$

which provides a compensation zero at $f_z$:

$$f_z = \frac{1}{2\pi C_1 R_1}$$

Given a typical value of $R_1$ of 1 MΩ, a 5 pF compensation capacitor would produce a zero at 32 kHz, which is exactly the frequency of the gate pole discussed above. Unfortunately, this compensation technique has a limitation that becomes increasingly severe for lower-voltage regulators. The feedback bypass capacitor actually produces a lead-lag network, with a pole $f_p$ at:

$$f_p = \frac{R_1 + R_2}{2\pi C_1 R_1 R_2}$$

The presence of this pole limits the range over which the zero can provide a phase boost, and therefore the magnitude of the phase boost. In practice, the pole-zero separation $f_p/f_z$ should equal at least 3–5 to obtain good results from this circuit. The ratio $f_p/f_z$ equals:

$$\frac{f_p}{f_z} = \frac{R_1 + R_2}{R_2}$$

The output voltage $V_o$ of the regulator is related to the Brokaw bandgap voltage $V_{bg}$ by the formula:

$$V_o = V_{bg}\frac{R_1 + R_2}{R_2}$$

where $V_{bg}$=1.25 V or thereabouts for minimum temperature variation. This implies that the pole zero separation $f_p/f_z$ equals:

$$\frac{f_p}{f_z} = 0.8V_o$$

This implies that the feedback bypass capacitor doesn't provide much benefit for output voltages below 3 V. Unfortunately, it is precisely these voltages that are of greatest importance in modem low-voltage applications. Therefore, the feedback bypass capacitor provides limited benefit. Many low-voltage LDO's still include feedback bypass capacitors because they neutralize the inevitable parasitic poles introduced by parasitic capacitance within the feedback divider.

Classical LDO designs generally combined ESR compensation with feedback bypass compensation. Such designs provided adequate performance so long as the output capacitor value and quiescent current remained relatively large. These conditions no longer universally apply.

Counterphase Compensation

According to the present invention, compensation of Brokaw transconductance cell arises from the inclusion of the Brokaw base-current compensating resistor $R_5$. This resistor cancels the error in output voltage caused by the base currents of transistors $Q_1$ and $Q_2$ flowing through divider $R_1$–$R_2$, providing that the value of $R_5$ equals:

$$R_5 = \frac{R_3}{R_4}\frac{R_1R_2}{R_1 + R_2}$$

The present invention derives technical advantages by adding a capacitor $C_2$ that generates a pole-zero pair in the Brokaw transconductance cell. This can be explained intuitively as follows:

The current at the base of transistor $Q_8$ equals $IC_2$–$IC_1$, so transistors $Q_1$ and transistor $Q_2$ operate in counterphase. In other words, an input to transistor $Q_1$ will produce an output signal at node $V_p$ 180° out-of-phase to the output signal generated in response to an input to transistor $Q_2$. Since a capacitor from the base of transistor $Q_2$ to ground would behave as a pole (90° phase lag), a capacitor from the base of transistor $Q_1$ to ground should produce a zero (90° phase lead). Resistor $R_5$ plays a vital role because it provides isolation between transistors $Q_1$ and $Q_2$ and allows the capacitor $C_2$ to affect only one of the two transistors $Q_1$ and $Q_2$. One would intuitively expect the zero to depend upon resistors $R_3$ and $R_4$, since these lie in the ground path from capacitor $C_2$, and one would expect to find a pole dependent upon resistor $R_5$.

An analysis of the OTA transfer function with the addition of $C_2$ reveals the following pole and zero frequencies:

$$f_p = \frac{1}{2\pi R_5 C_2}$$

$$f_z = \frac{R_3}{2\pi R_5(r_e + R_3 + 2R_4)C_2}$$

where $r_e$ is the emitter resistance ($V_T/I_C$) of one of the Brokaw transistors $Q_1$–$Q_2$. Since resistors $R_3$ and $r_e$ are both considerably smaller than $2R_4$, the zero frequency can be approximated as:

$$f_z \cong \frac{R_3}{4\pi R_5 R_4 C_2}$$

and the pole-zero separation $f_p/f_z$ equals:

$$\frac{f_p}{f_z} \cong \frac{2R_4}{R_3}$$

One important conclusion can be immediately drawn from the above equation: to a first-order approximation, the pole-zero separation does not depend on $R_1$, $R_2$ or $R_5$. In practice, the ratio $R_4/R_3$ is forced to about six by the requirement that the Brokaw cell produce a bandgap voltage $V_{bg}$≈1.25 V, the value required for temperature independence. This implies a pole-zero separation of about 12, providing a phase boost approaching 90° which is independent of the output voltage of the LDO. This is an extremely important result, as it shows that the counterphase compensation has a quality lacking in feedback bypass compensation, namely, the ability to compensate low-voltage regulators that have low attenuation ratios. The frequency of the zero actually depends upon $R_1$ and $R_2$, as can be seen by substituting equation of $R_5$ above into the equation for $f_z$ above:

$$f_z = \frac{R_1 + R_2}{4\pi R_1 R_2 C_2}$$

The zero frequency does not depend upon the attenuator ratio, but does depend upon the parallel combination resistance $R_1 \| R_2$, which approaches $R_1$ for low attenuator ratios. Even so, the value of $C_2$ can still be boosted to provide the necessary zero. A typical micropower regulator might have a parallel resistance $R_1 \| R_2$=1 MΩ, and a 5 pF compensation capacitor $C_2$ would provide a zero at 16 kHz.

In summary, the counterphase compensation capacitor provides a low-frequency zero using a reasonably sized capacitor $C_2$, whose pole-zero separation does not depend upon attenuator ratio, and therefore is independent of output voltage, and which requires no additional current-consuming components. This technique can be combined with both feedback bypass compensation and ESR compensation to provide a wide-range phase boost capable of compensating a micropower LDO based upon the Brokaw transconductance cell. The illustrated circuit 30 uses an OTA configuration about the transconductance cell, but the technique is more general and can be applied to any amplifier based on the Brokaw cell.

Though the invention has been described with respect to a specific preferred embodiment, many variations and modifications will become apparent to those skilled in the art upon reading the present application. It is therefore the intention that the appended claims be interpreted as broadly as possible in view of the prior art to include all such variations and modifications.

We claim:

1. A voltage regulator producing an output signal, comprising:

a Brokaw cell comprising a first transistor and a second transistor, each having a base; and a frequency compensation circuit coupled to said Brokaw cell generating a pole-zero pair in said Brokaw cell, wherein said compensation circuit comprises a base-current compensating resistor coupled between said first and second transistor bases and a capacitor coupled to said compensating resistor, wherein said compensation circuit is configured to compensate the voltage regulator even when having a low attenuation ratio, and wherein said compensation circuit is configured to have a zero frequency that is independent of the attenuation ratio.

2. The voltage regulator as specified in claim 1 wherein said first and second transistors operate in counterphase to generate respective output signals 180° out-of-phase to one another.

3. The voltage regulator as specified in claim 1 wherein said compensation circuit is configured to provide a phase boost approaching 90° and which is independent of the output signal of the voltage regulator.

4. The voltage regulator as specified in claim 1 wherein said pole-zero pair defines a pole-zero separation, wherein said pole-zero separation is independent of an attenuation ratio of the voltage regulator.

5. The voltage regulator as specified in claim 1 further comprising a feedback bypass compensation circuit and an ESR compensation circuit providing a wide-range phase boost of said compensation circuit.

6. The voltage regulator as specified in claim 1 wherein said Brokaw cell comprises a transconductance Brokaw cell.

7. A voltage regulator producing an output signal, having a voltage potential, comprising:

a Brokaw cell comprising a first transistor and a second transistor each having a base;

a first resistor coupled between said bases of said first and second transistors; and a first capacitor coupled between one said transistor base and said voltage potential, wherein said voltage regulator has an attenuation ratio, wherein said first resistor and first capacitor provide a zero frequency and a pole frequency, wherein said zero frequency and said pole frequency define a pole-zero separation and wherein said pole-zero separation is independent of the attenuation ratio.

8. The voltage regulator as specified in claim 7 wherein each said transistor has an emitter further comprising a second resistor coupled between said first and second transistor emitters, and a third resistor coupled to said second resistor defining a voltage divide circuit.

9. The voltage regulator as specified in claim 7 wherein said Brokaw cell comprises a Brokaw transconductance cell.

10. The voltage regulator as specified in claim 7 wherein said first resistor and said first capacitor produce a phase boost approaching 90°.

11. The voltage regulator as specified in claim 10 wherein said phase boost is independent of the output signal of the voltage regulator.

12. The voltage regulator as specified in claim 7 wherein said first and second transistors operate in counterphase to generate respective output signals 180° out-of-phase to one another.

13. The voltage regulator as specified in claim 7 wherein said compensation circuitry comprises a feedback bypass compensation circuit and an ESR compensation circuit providing a wide-range phase boost of said compensation circuit.

14. The voltage regulator as specified in claim 7 wherein said first resistor and said first capacitor are configured to compensate the voltage regulator having a low attenuation ratio.

15. A voltage regulator producing an output signal, having a voltage potential, comprising:

a Brokaw cell comprising a first transistor and a second transistor, each having a base; and a frequency compensation circuit coupled to said Brokaw cell generating a pole-zero pair in said Brokaw cell, wherein said compensation circuit comprises a base-current compensating resistor coupled between said first and second transistor bases and a capacitor coupled between said compensating resistor and said voltage potential and wherein said base-current compensating resistor and said capacitor produce a phase boost between 30° and 90°.

* * * * *